United States Patent [19]

Miller

[11] Patent Number: 4,460,084

[45] Date of Patent: Jul. 17, 1984

[54] PLURAL CONTAINER PACKAGE

[75] Inventor: John L. Miller, Toledo, Ohio

[73] Assignee: Owens-Illinois, Inc., Toledo, Ohio

[21] Appl. No.: 417,016

[22] Filed: Sep. 13, 1982

[51] Int. Cl.[3] ..... B65D 71/06; B65D 75/00; B65D 25/22

[52] U.S. Cl. ..... 206/158; 206/428; 206/150; 206/161

[58] Field of Search ..... 206/150–159, 206/161, 427, 428; 294/87.2, 87.26; 229/52 BC

[56] References Cited

U.S. PATENT DOCUMENTS

| | | | |
|---|---|---|---|
| 2,997,169 | 8/1961 | Poupitch | 206/150 |
| 3,084,792 | 4/1963 | Poupitch | 206/150 |
| 3,410,596 | 11/1968 | Slevin, Jr. | 206/158 |
| 3,721,337 | 3/1973 | Braun et al. | 294/87.2 |
| 4,093,295 | 6/1978 | Erickson | 206/150 |
| 4,234,081 | 11/1980 | Champlin | 206/429 |
| 4,249,766 | 2/1981 | Erickson | 206/150 |
| 4,300,681 | 11/1981 | Klygis et al. | 206/428 |
| 4,316,538 | 2/1982 | Manizza | 206/158 |
| 4,339,032 | 7/1982 | Wood | 206/158 |
| 4,378,878 | 4/1983 | Graser | 206/161 |

FOREIGN PATENT DOCUMENTS

| | | | |
|---|---|---|---|
| 80494 | 3/1963 | France | 294/87.2 |

*Primary Examiner*—William T. Dixson, Jr.
*Assistant Examiner*—Brenda J. Ehrhardt
*Attorney, Agent, or Firm*—Thomas L. Farquer; M. E. Click

[57] ABSTRACT

A plural container packaged for securing together a plurality of identical containers, each said container having an open neck finish, an outstanding bead portion disposed below said finish portion, an angled shoulder portion disposed below said bead portion and an elongate hollow enlarged diameter main body portion having a closed bottom, in communication with said finish opening. The package includes a plurality of such containers, in a regular geometric array, with a unitary cover shroud overlaying each container in the array such that the upper portion of the cover shroud is subjacent to the bead portion of the containers and the lower portion of the cover shroud extends approximately to the midpoint of the container main body portion. A first container securing means interconnects each container at a point immediately subjacent to the bead portion of the container and superjacent to the cover shroud. A second container securing means is disposed about the container array and overlays the lowermost portion of the cover shroud.

9 Claims, 13 Drawing Figures

PLURAL CONTAINER PACKAGE

BACKGROUND OF THE INVENTION

The invention relates generally to plural container packages and more specifically to a three component assembly which restrains a grouping of containers about their necks and midsections.

The consumer beverage container market is innovative, fast moving and extremely cost competitive. Innovative because new materials and processes permit new structural configurations and ornamental designs, fast moving due not only to the above-described influences but also the changeability of consumer preferences and trends placing a premium on a contemporary package concept and competitive inasmuch as the high production volume of such containers encourages and rewards low per unit cost and high durability packages. Intrinsically tied to the consumer container market and exhibiting many of the same market characteristics as containers are container packaging products. This is not surprising since as containers evolve so must their packages.

Numerous package structures are described in the prior art. For example, U.S. Pat. No. 3,186,544 teaches a carrier having a plurality of cinctures or loops which extend about a like plurality of containers having an outwardly directed circumferential bead about their midsections. The carrier also includes a pair of lifting handles. This device would appear to function only with containers which have been specially formed to include the circumferential bead, thus increasing container fabrications costs. U.S. Pat. No. 3,476,237 teaches a package construction similar to what has become known as shrink wrap packing. In addition to an outer shrink wrap, however, the package includes a plurality of orienting clips which maintain the containers in adjacent parallel alignment. Aside from routine difficulties of removing the contents from a shrink wrap pack, this configuration appears to incorporate a significant quantity of material in the form of orienting clips and thus its attractiveness from an economic standpoint is reduced.

Specially shaped containers often engender specially shaped carriers and U.S. Pat. No. 3,702,203 discloses just such a carrier. Here, a pair of high-waisted containers are engaged by a single strap having a finger loop disposed at each end. The strap is disposed about the waists of the containers in a figure-eight pattern and the loops are juxtaposed intermediate the containers to form a unitary gripping means. A somewhat related device is disclosed in U.S. Pat. No. 3,709,544. Here, a tee-shaped or alternately right angle strap is disclosed which is intended for use with containers having peripheral lips such as coffee cans or paint cans. With either strap configuration, a portion of a strap extends about the periphery of the container, directly below the bead and is secured to itself. The remaining portion of the strap forms a handle which stands above the container to facilitate manual engagement. Since no provision appears to have been made in the strap for adjusting its length, it therefore appears that the strap could not be utilized with but one container size inasmuch as the strap must fit snugly about the container if it is to be precluded from slipping past the relatively small lip. Another approach to holding a pair of identical containers is disclosed in Great Britain Pat. No. 2,051,723. This patent discloses a package which comprises a tubular wrapping of elastic plastics around a number of identical uprightly stable containers, in a side by side arrangement. Before being fitted over the bottles, the wrapping is a flat tubular section with the same peripheral dimension at the top and bottom ends, this being larger than the container cap portions and necks but smaller than the body portions and shoulder portions. In one embodiment the necks of the containers are secured together by band means.

SUMMARY OF THE INVENTION

The instant invention comprehends a multipart package assembly for holding two or more individual indentical containers, such as, for example beverage containers. The package comprises a bipartite carrier which secures together a plurality of identical containers. A cover shroud is disposed subjacent a first portion of the carrier and under a second portion of the carrier. The first portion of the carrier or inner member includes regions which receive the necks of each of the containers in the plural grouping of containers and a second or outer member which extends about the plural grouping of containers at about their vertical midsections and overlays the cover shroud. The inner and outer members of the carrier means may be punched simultaneously from a flat sheet of material, such as, for example low density polyethylene. The inner member is sized to nest within the outer member, having a common series of edge portions which are scored or perforated along the connection between the inner and outer members. Such scoring or perforation is accomplished by a punching die. Assembly of the package is mechanically straight forward and requires a minimal number of operating steps and assembly devices. The present package is fabricated by grouping a preselected number of containers complementary to the number of neck engaging apertures in a complementary array to the carrier apertures. Next, a single unitary cover shroud having similarly disposed complementary neck receiving apertures is placed over the container. The cover shroud assists in holding the containers together and increases the overall package rigidity. The cover shroud further provides for light protection to sensitive container contents. The cover shroud is designed to require minimal folding, sealing, adhesing and iner locking to form a unitary cover shroud. Subsequent to application of the cover shroud, the bipartite carrier means is lowered onto the necks of the container and forcibly pushed downwardly of the containers. As the carrier means is pushed downwardly, the first and second portions sever along the perforation lines. The first or inner portion engages the necks of the containers to hold them in the regular geometric array. The second portion or outer portion is forced down to a position approximately coterminous with the lower edge of the cover shroud to further stabilize the package and thereby forces the cover shroud into engagement with the containers.

The package according to the present invention provides substantial package rigidity, increased light protection for container contents, minimal handling and assembly steps and provides for increased protection of the container during shipment and storage. Further the package provides excellent billboard space for product identification.

DESCRIPTION OF THE PREFERRED EMBODIMENTS

Figure 1:
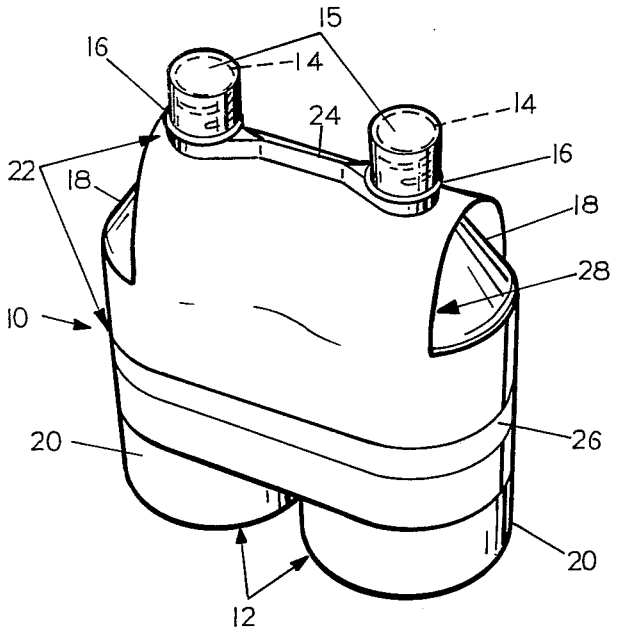
FIG. 1 is a perspective view of a first embodiment of the package according to the present invention for holding two containers.

Referring now to FIG. 1, there is illustrated a package 10 for carrying a plurality of cotainers 12. The package 10 is particularly well-suited to carrying two identical containers 12. Each container 12 includes a threaded finish 14, shown in phantom, which receives an internally threaded complementary closure 15. At the base of the finish is an outstanding peripherally located bead portion 16 occasionally called a finish ledge. Disposed immediately below the portion 16 of the finish 14 is an angled shoulder portion 18. The shoulder portion 18 blends into an enlarged diameter main body portion 20 of the container which at its lowermost portion is sealed to form a closed bottom. The package 10 includes a bipartite carrier 22. The carrier 22 includes a first or inner portion 24 and a second or outer portion 26. A single sheet, unitary cover shroud 28 encases the uppermost portion of the containers 12. The cover shroud 28 has its upper edge located immediately subjacent to the first portion 24 of the carrier 22. The lowermost portion of the cover shroud 28 terminates immediately below the second portion 26 of the carrier means 22. The edges of the cover shroud 28 abut when the shroud 28 is in place over the container array as illustrated.

Figure 2:
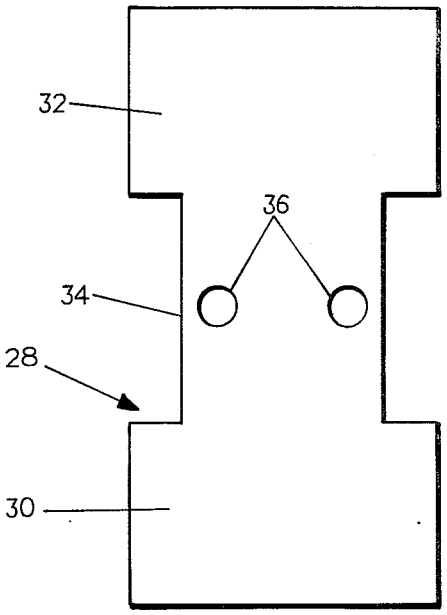
FIG. 2 is a plan view of the cover shroud illustrated in FIG. 1.

Referring specifically to FIG. 2, there is shown a plan view of the cover shroud 28 illustrated in FIG. 1 in the uninstalled configuration. The cover shroud 28 includes a first or front panel 30, a second or rear panel 32 and a panel connecting portion 34. The connecting panel 34, when in place over the containers 12 forms a container shoulder engaging portion. A pair of container receiving apertures 36 are formed in the connecting portion 34 which receive the necks of the containers 12. The cover shroud 28 is generally formed from paperboard, preferably varnish finished paperboard with a printed product identifying information thereupon. In operation, the cover shroud 28 is formed as a die cut blank from a continuous feedstock which is positioned superjacent to the containers in proper registry therewith such that the closures 15 and beads 16 fit through the apertures 36. The cover shroud 28 is lowered onto the container array and forced downwardly by installation of the carrier 22 such that the portions 30 and 32 overlap one another at their edges. In one embodiment of the invention, the edges of the portions 30 and 32 are then secured together by any suitable means, such as, for example a hot melt adhesive or tape like material. However, such adhesion of the edges of the portions 30 and 32 is not required according to the present invention, but adds structural rigidity to the package. Typically the elastic recovery of the second carrier portion 26 is sufficient to hold the portions 30 and 32 of cover shroud 28 in place and thereby preclude the necessity of portions 30 and 32 overlapping.

As is clearly illustrated in FIG. 1, the cover shroud 28 is secured at its lower portion by the second carrier portion 26. The upper portion of the container shoulders 18 immediately subjacent to the bead 16, are held together by the first carrier portion 24. As illustrated, the carrier portion 24 is stretched over the closures 15 and under the beads 16 and allowed to snap, via elastic recovery into engagement with the upper portions of the shoulder 18 to securely hold the upper portions of the containers 12 together. When so assembled, the package can, according to the present invention, provide a stable, rigid, light protective unitary package for the shipping and delivery of a plurality of containers with excellent billboard characteristics. The invention exhibits the particular advantage that the carrier 22 is simple to fabricate and install. Further, the single piece die cut cover shroud 28 is extremely easy to fabricate and install, requiring minimal forming and installation steps. Note that no adhesive or other securing means is required to maintain a cover shroud 28 in place, rather the second carrier portion 26 provides such function. This further adds to the overall economy of production for the present package 10, in the preferred embodiment of the invention wherein no securing means, other than portion 26, holds the shroud 28 in engagement with the containers 12.

Figure 3:
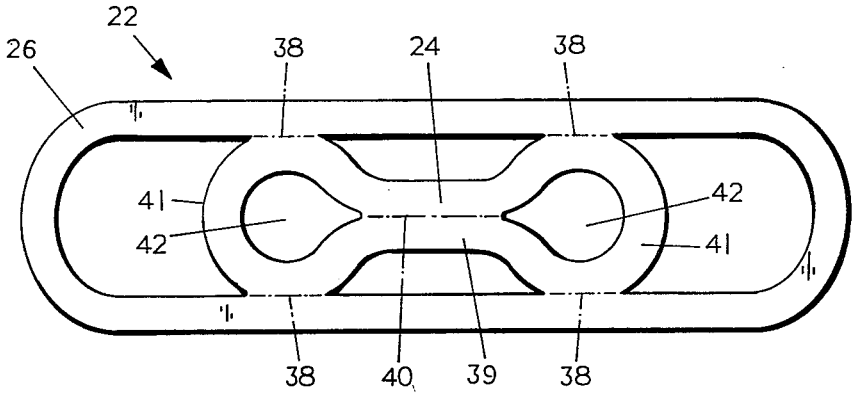
FIG. 3 is a plan view of the carrier means, in the assembled fashion prior to installation, illustrated in FIG. 1.

FIG. 3 illustrates the embodiment of the carrier 22 illustrated in FIG. 1 in detail. FIG. 2 illustrates the post-production and pre-assembly state of the embodiment of the carrier means 22 illustrated in FIG. 1. The first portion 24 defines a dog bone or closed figure-eight pattern disposed within and having outer edges in common with the inner edge of the second portion 26 of the carrier 22, which defines an elongate oval space or fitment of the first portion 24. The first portion 24 includes a central rectangular interconnecting web 39 terminating at its ends in a pair of curvilinear closed container engaging loops 41. The regions of common edge, that is the coinciding portions of the outer edge of the first portion 24 and the inner edge of the second portion 26, are defined by perforated scored lines 38 to facilitate separation of the individual portions 24 and 26 of the carrier 22 upon installation. A centrally located inner score line 40 is disposed along the center most portion of the first carrier portion 24. The score line 40 provides for ease of folding of the area adjacent to the score line 40 when the carrier 22 is installed on the containers 12. The first carrier portion 24 also defines a pair of apertures 42 which are sized to snugly stretch in frictional engagement of the upper portion of the shoulders 18 of the container 12, immediately subjacent the beads 16, as illustrated in FIG. 1.

Figure 4:
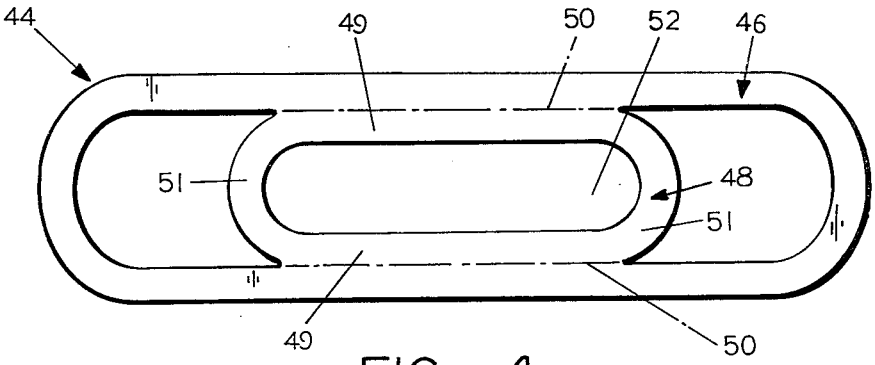
FIG. 4 is a plan view of an alternative embodiment of the carrier illustrated in FIG. 1, in the assembled fashion prior to installation.

Referring now to FIG. 4, a second, alternative embodiment body of a carrier means 44 useful with the present package 10 is illustrated. The carrier 44 includes a first or outer portion 46 and a second or inner portion 48. The portions 46 and 48 are joined at two points along their common edges by score lines 50. The inner edge of the second portion 48 defines an aperture 52 which is generally oval in shape and engages the upper portions of the shoulders 18 of the containers 12, immediately subjacent the beads 16, in the same fashion as portion 24 of carrier 22 engages such shoulder portions 18. The inner portion 48 includes a pair of side portions 49 and a pair of curvilinear end portions 51. As in the embodiment of the invention in FIG. 3, the embodiment of the invention in FIG. 4 similarly snugly, frictionally fits tightly about the upper part of the shoulder portions 18 of the containers 12 and under the bead portions 16 of the containers 12.

Figure 5:
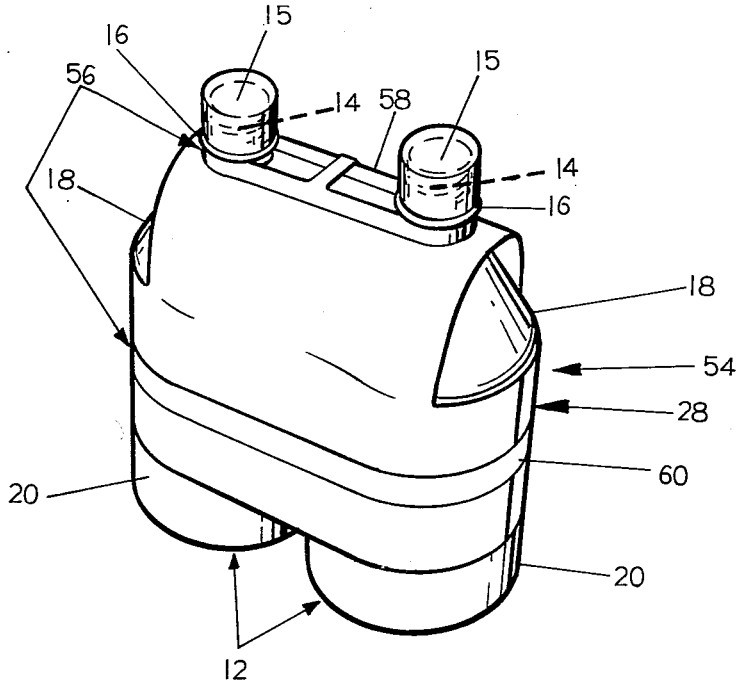
FIG. 5 is a perspective view of an alternative embodiment of the package including another embodiment of a carrier.

Referring now to FIG. 5, there is illustrated a third embodiment of the package according to the present invention. A package 54 includes a pair of containers 12, identically to the containers 12 illustrated in FIG. 1, each container 12 including a finish 14, closure 15, bead 16, shoulder portion 18 and an enlarged main body portion 20 forming a closed end portion of the container 12. The embodiment of the invention illustrated in FIG. 5 includes a bipartite carrier 56 including a first or inner carrier portion 58 and a second or outer carrier portion 60. The first carrier portion 58 is located immediately subjacent the bead 16 at the upper part of the shoulder portion 18 of each container 12. As in the embodiment of FIG. 1, the first carrier portion 58 is snapfitted over the closures 15 and into frictional engagement with the upper portion of the shoulders 18 and immediately below the beads 16 to hold the container necks together. Similarly, the second carrier portion 60 fits frictionally around the midsection of the main bodies 20 of the containers 12 to hold them in a side by side arrangement. The cover shroud 28, identical to the cover shroud 28 of FIG. 1, is similarly fitted underlying the second carrier portion 60 and subjacent to the first carrier portion 58.

Figure 6:
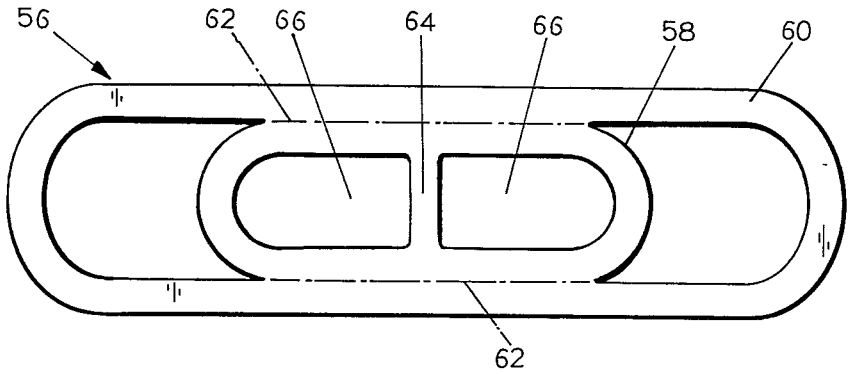
FIG. 6 is a plan view of the carrier illustrated in FIG. 5, in the assembled fashion prior to installation.

FIG. 6 illustrates in more detail the carrier 56 illustrated in FIG. 5. The carrier 56 includes the first or inner portion 58 and a second or outer portion 60. The portions 58 and 60 are joined about their respective edges by perforated score lines 62 such that they are readily separable upon installation over the containers 12. The first carrier portion 58 includes a centrally located generally rectangular inner connecting web 64 which separates the first carrier portion 58 into two discrete sections thereby forming a pair of apertures 66, which accept the necks of the containers 12. The web 64 provides a readily engagable handle means which improves the overall convenience and transportability of the package 54. As in the invention illustrated in FIGS. 1–4, the outer or second portion 60 forms a generally ovoid space for nesting of the first carrier portion 58 therewithin.

Figure 7:
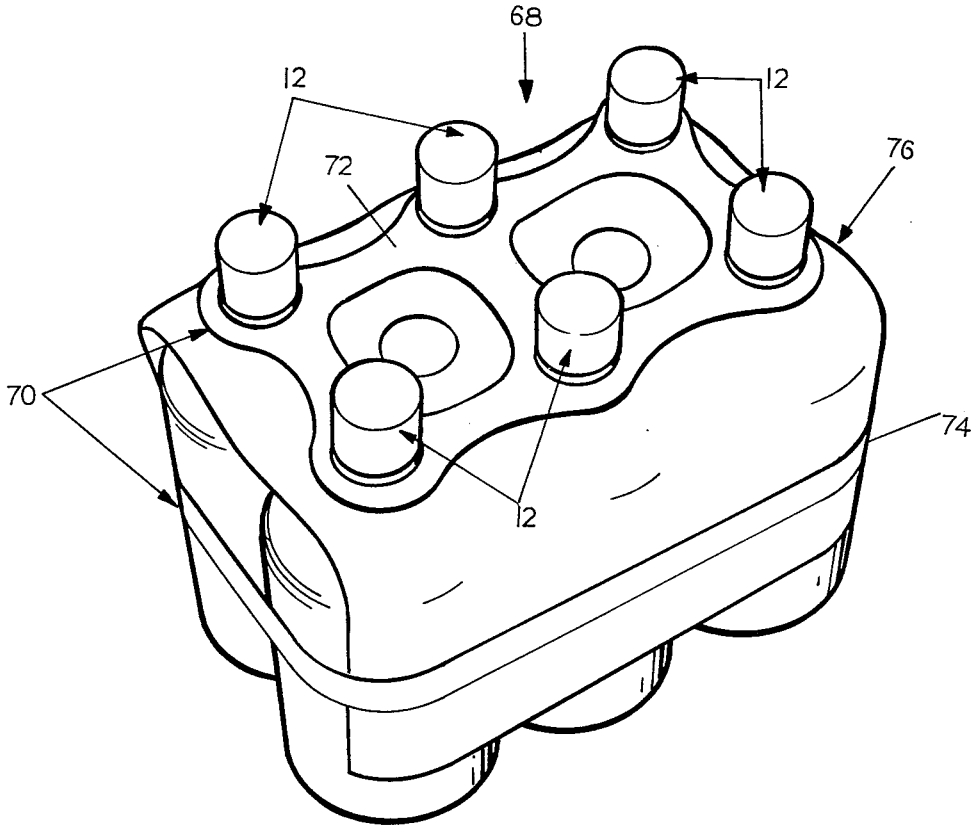
FIG. 7 is a perspective view of an embodiment of a six container package according to the present invention.

Referring now to FIG. 7, an alternative embodiment of the package according to the present invention is illustrated which is intended for use with six identical containers 12 a so-called six pack. Such container is previously described in detail. A six container package 68 is illustrated which includes a bipartite carrier 70 having a first web portion 72 and a second band portion 74. Disposed subjacent to the first web portion 72 and surrounded by and underlying the second band portion 74 is a single piece, unitary cover shroud 76.

Figure 8:
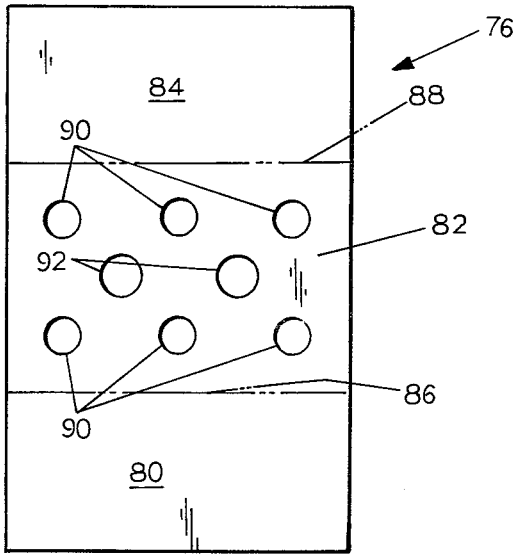
FIG. 8 is a plan view of the cover shroud illustrated in FIG. 7.

The cover shroud 76 illustrated generally in FIG. 7 is illustrated in greater detail in FIG. 8. The cover shroud 76 includes a first or front panel 80, a center panel 82 and a second or rear panel 84. The panels 80 and 82 are connected by a fold line 86 while the panels 82 and 84 are connected by a fold line 88. The fold lines 86 and 88 aid in the bending of the longest axis of the cover shroud 76 for ease of installation over the six containers 12. The center panel 82 of the cover shroud 76 includes six container apertures 90, which are designed to be in registry with and easily fit over the closures 15 and upper portions of the shoulder 18 of the containers 12. The center panel 82 also includes a pair of apertures 92 which serve as hand grips for convenient handling of the package by gripping the cover shroud 76 via the apertures 92. When the cover shroud 76 is in place over the array of containers 12 the center panel 82 acts as a container shoulder engaging means to assist in holding the containers 12 in proper array.

Figure 9:
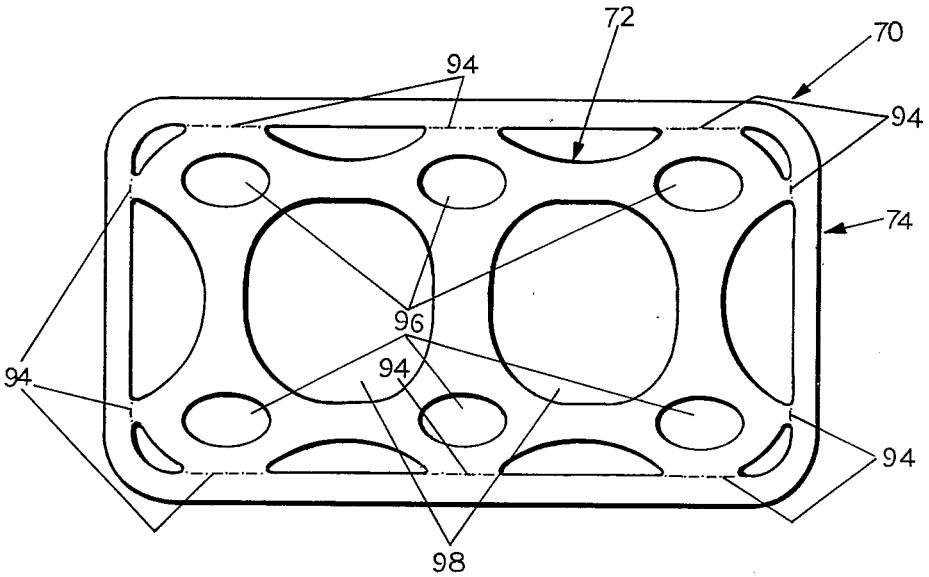
FIG. 9 is a plan view of the carrier means illustrated in FIG. 7.

The bipartite carrier 70 of the package 68 is illustrated in greater detail in FIG. 9. The first web portion 72, disposed internally of the second band portion 74, is secured to the second portion band 74 by a plurality of edge interface score lines 94, which are readily severable upon mechanical stress. A plurality of container receiving apertures 96 are provided in the web portion 72. The container apertures 96 are sized smaller than the shoulder portions 18 of the containers 12 immediately subjacent the beads 16 so as to be adapted to be expandable over the bead portions 16 of the container 12 to snap fit below the beads of the containers 12 in tight frictional engagement. The first web portion 72 further includes a pair of hand grip apertures 98 which are so disposed as to be in registry with the cover shroud hand grip apertures 92. It is understood that the six container package according to FIGS. 7–9 is structurally analogous to the package illustrated in FIGS. 1–6.

Figure 10:
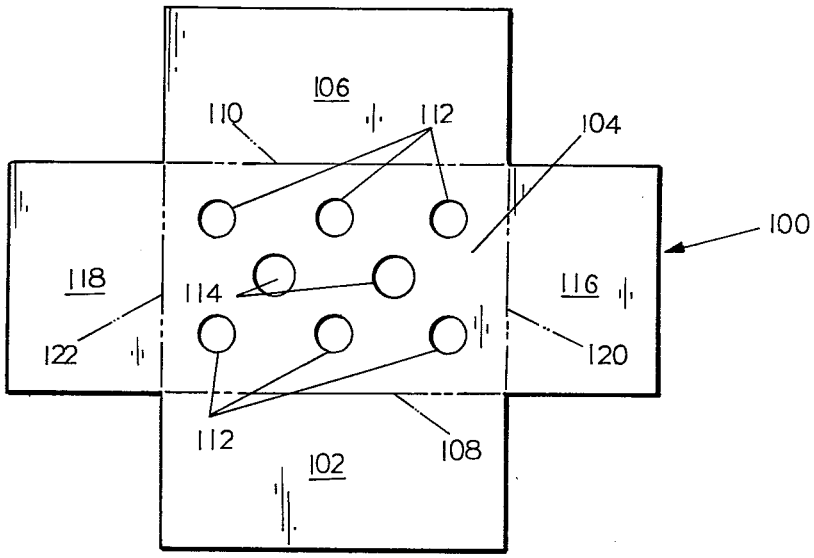
FIG. 10 is a plan view of an alternative embodiment of the cover shroud illustrated in FIG. 8.

An alternative embodiment of the cover shroud 76 illustrated at FIG. 8 is illustrated at FIG. 10. A cover shroud 100 includes a first or front panel 102, a center panel 104 and a second or rear panel 106. The panels 102 and 104 are connected by a fold line 108 while the panels 104 and 106 are connected by a fold line 110. The fold lines allow for ease of bending of the portions 102 and 106 toward the sides of the container 12 of the package 68 during installation of the shroud 100 over the containers 12. The center panel 104 includes a plurality of container receiving apertures 112 in the complementary geometric array to that array of the containers 12, typically a six pack array of two side by side three container linear arrays. The center panel 104 additionally includes a pair of hand grip apertures 114. The hand grip apertures 114 are in registry with the aperture 98 on carrier 70. To provide for the total encasement of the upper portions of the containers 12 the cover shroud 100 is further provided with a pair of side portions, namely a first side panel 116 and a second side panel 118. The side panel 116 is attached to the center panel 104 by the fold line 120 while the second side panel 118 is connected to the center panel 104 by the fold line 122.

When the cover shroud 100 is dropped onto the six pack array of containers 12, the panels 102, 106, 116 and 118 stand out in a parallel plane to the center panel 104. As the carrier 70 is installed over the six pack array of containers 12, the first web portion 72 grips the upper portion of the containers 12, thereby holding them in place as a six pack while the second band portion 74 of the carrier 70 shears from the first web portion 72 and forcibly folds the portions 102, 106, 116 and 118 down into a total encasement cover shroud 100 for the upper portions of the container 12. When installed the edges of the portions 102, 106, 116 and 118 abut and may be seated together for extra package rigidity if desired.

Figure 10A:
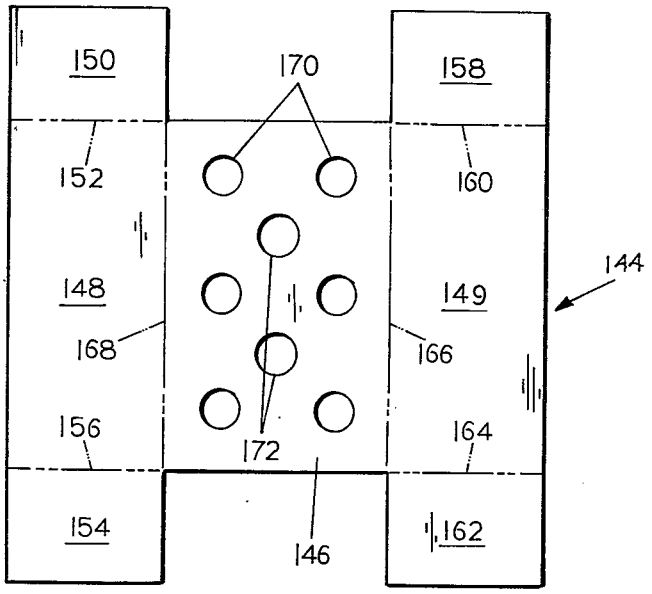
FIG. 10*a* is a plan view of an alternative embodiment of the six container cover shroud illustrated in FIG. 10.

Another embodiment of the cover shroud illustrated at FIG. 10 is illustrated in FIG. 10*a*. A cover shroud 144 includes a center panel 146 and a first side panel 148. An end panel 150 is affixed to one end of the first side panel 148 by a fold line 152. An end panel 154 is opposed to the end panel 150 and is similarly affixed to the first side panel 148 by a fold line 156. A second side panel 149 is affixed to the center panel 146 by a fold line 166. A pair of end panels 158 and 162 are located at opposed ends of the second side panel 149 and connected thereto by a pair of fold lines, 160 and 164, respectively. The first side panel 148 is connected to the center panel 146 by a fold line 168. Similarly, the second side panel 149 is connected to the center panel 146 by a fold line 166. A plurality of container receiving apertures 170 are disposed upon the center panel 146, typically in a six pack style comprising two side-by-side three container linear arrays. A pair of hand grip apertures 172 are disposed upon the center panel 146 and provide for easy grasping of the cover shroud 144.

The cover shroud 144 is installed over a six pack container array by placing the apertures 170 in registry with the necks of the containers and forcing the cover shroud 144 over the necks of the containers. Subsequently, a carrier like the carrier 70 illustrated at FIG. 9 is forced over the cover shroud 144 thereby folding down the panels 148, 150, 154, 149, 162 and 158 to form a total encasement shroud for the six pack array of containers. This embodiment and the embodiment illustrated in FIG. 10 of a cover shroud is particularly advantageous when storing such products as so-called light beers which are particularly sensitive to sunlight. The total encasement cover shrouds illustrated in FIGS. 10 and 10*a* provide for maximum sunlight protection of the contents and advantageously provide for maximum advertisement space for the product being marketed.

Figure 11:
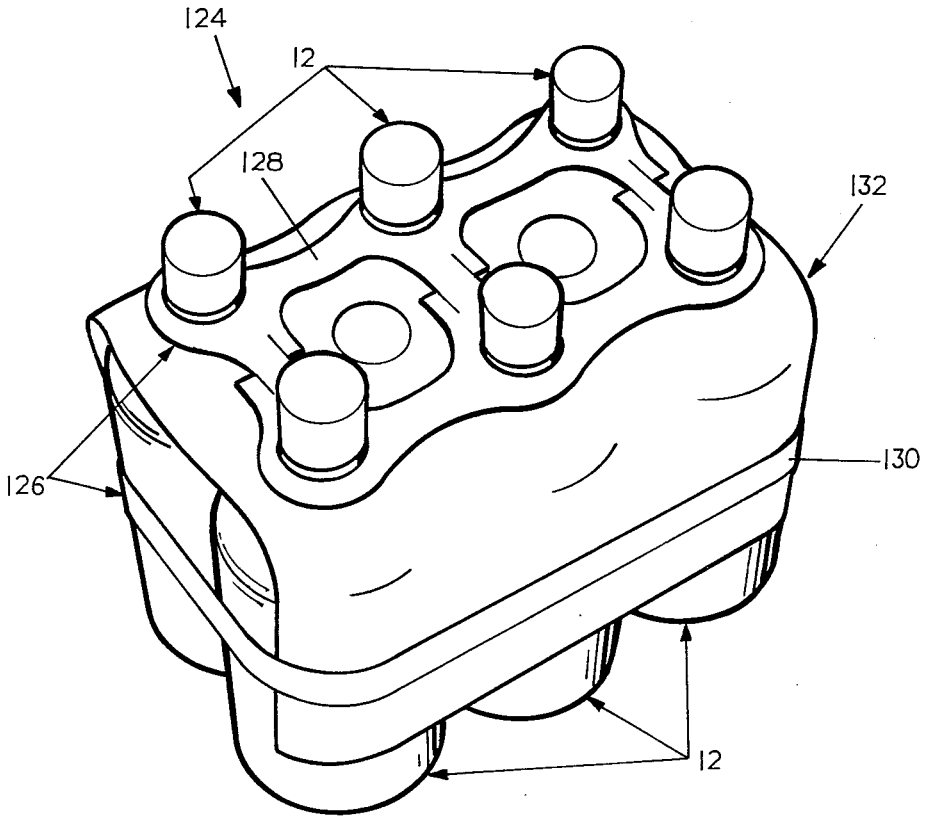
FIG. 11 is a perspective view of an embodiment of a six container package according to the present invention.
Figure 12:
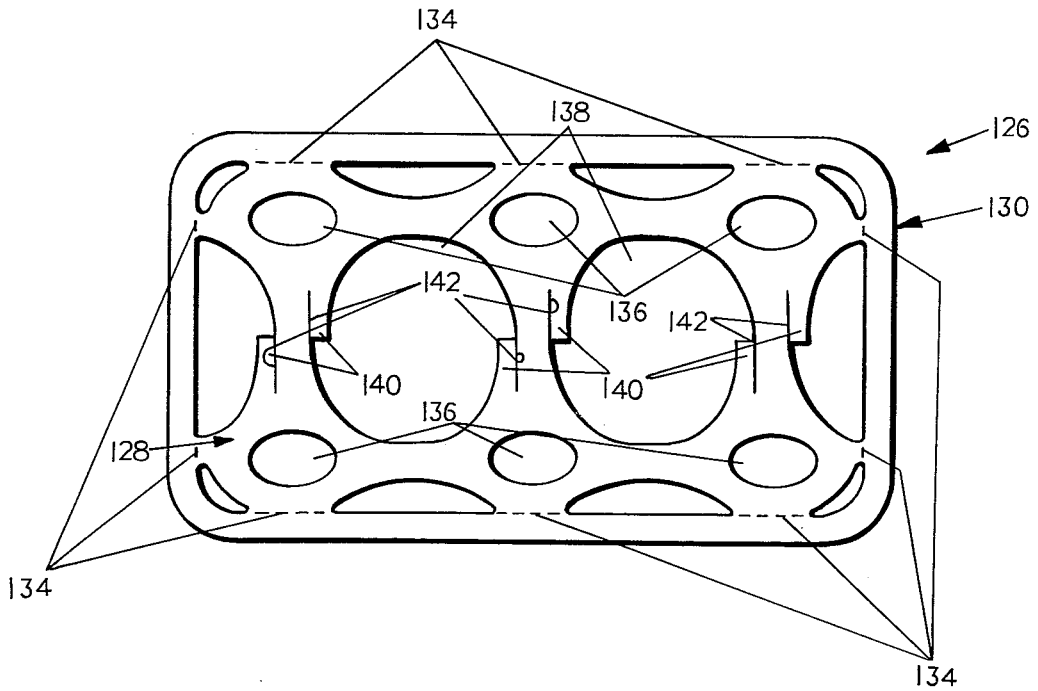
FIG. 12 is a plan view of the carrier illustrated in FIG. 11.

Still a further embodiment of the present invention is illustrated in FIGS. 11 and 12. A package 124 includes a bipartite carrier 126 having a first or inner web portion 128 and a second or outer band portion 130. A cover shroud 132 is disposed subjacent to the first web portion 128 and is restrained by and underlays the second band portion 130. A plurality of containers 12, identical to the containers disclosed at FIG. 1, are contained in a six pack array of 2 three can adjacent linear arrays. The cover shroud 132 is identical to the cover shroud 76 disclosed at FIG. 8. Further, the cover shroud 132 may be replaced by the cover shroud 100 of FIG. 10 for a total encasement embodiment of the invention illustrated in FIG. 11.

FIG. 12 illustrates in greater detail the features of the carrier 126 of package 124. The carrier includes the first or inner web portion 128 which is nested within the outer or second band portion 130. The portions 128 and 130 have a number of common edges which are joined together by perforated score lines 134 to provide the bipartate carrier means prior to installation upon the package 124. A group of container receiving apertures 136 are provided within the web 128 to snugly frictionally engage the containers 12 under their respective bead 16 in formation of the package 124. Similarly to the embodiment of the invention illustrated in FIG. 9, a pair of hand grip apertures 138 are provided centrally located in the web 128 for convenience of carrying the assembled package 124. The aperture 138 are in registry with the aperture in the cover shroud 132. Carried in this embodiment of the invention a plurality of centrally located tabs 140 are formed in the web 128. The tabs 140, as illustrated in FIG. 12, are formed in opposed pairs on either side of the apertures 138. The tabs 140 are separated from the main body of the web 128 by perforated score lines 142. The perforated score lines 142 as best illustrated in FIG. 11, allow the user to grasp a tab 140, pulling the tab 140 to sever the score line 142 and thereby tear away that portion of the web 128 most adjacent to the shoulder 18 of the container 12. This allows the consumer easy access to an individual container 12 without destroying the structural integrity of the remainder of the web 128.

With reference now generally to all of the drawing figures, assembly of the various embodiments of the plural container package according to the present invention will be described. The assembly operations for all of the embodiments of the invention are similar in that all the packages are fabricated initially using a plurality of containers in a regular geometric array, a bipartite carrier and a unitary single sheet cover shroud. The carrier illustrated in FIGS. 3, 4, 6, 9 and 12 are initially fabricated from a flat plastic sheet into the forms illustrated in the referred to figures by conventional sheet stamping and scoring techniques.

Similarly, the cover shrouds illustrated in FIGS. 2, 8 and 10 are formed by conventional die cutting techniques from a larger continuous strip of feed stock. Typically, the feed stock comprises a paperboard of conventional composition which has preprinted advertisements thereupon, such advertisements being covered with a conventional print protecting varnish to prevent abrasion or scuffing and discoloration of the advertisement on the cover shroud. Subsequently, the cover shroud is positioned over a juxtapositioned pair of containers (as illustrated in FIGS. 1 and 5) or a juxtapositioned pair of linear three can arrays, to form a six pack, (as illustrated in FIGS. 7 and 11) and the container accepting apertures are aligned with the closures of the containers in the array. Subsequently, the cover shroud is moved downwardly over the closures and the beads of the containers to rest on the container shoulders. Typically, the cover shroud is not forced into close engagement with the containers of the array at this point. Next, the bipartite carrier is similarly placed in juxtaposition to the containers which now are covered by the shroud and moved downwardly over the closures and beads of the containers such that the first inner band or the web portions illustrated in FIGS. 9 and 12 are disposed about the necks of the containers. When the inner or first portions of the bands or webs are fully seated in frictional engagement about the necks of the containers, they remain substantially fixed in the position until the containers are forcibly removed therefrom. In further assembly operation, the outer bands are moved further down over the container side walls, and by virtue of this movement, force the cover shroud into close frictional engagement with the containers. The second bands are forced to a position approximately in the midsections of the containers. The above described operations produce the package according to the present invention which is structurely rigid, product protective and inexpensive to assemble. Note that only two die cut members, namely the bipartite carrier, which is severed into two discrete members during the installation process, and the single sheet cover shroud are required in addition to the containers, to fabricate the package. Note that no complex adhesing, tab insertion, fold line indexing or similar common packaging operations are required. The package according to the present invention exhibits substantial advantage over prior packages in that it involves a minimal number of assembly steps and a minimal number of discrete units in its fabrication, each such unit (cover shroud or bipartite carrier) being simply fabricated from inexpensive materials.

With respect to all of the embodiments of the carrier according to the present invention, such carriers are preferably fabricated from low density polyethylene or similar elastic thermoplastic materials. The primary determinant in selecting the material is that it exhibits good elastic recovery. That is, the material must be capable of being stretched over the closures and beads of the containers as well as over the bodies of the containers and then rapidly recover from the stretched condition to frictionally grip the containers tightly such that the bands and webs remain in their proper location and thereby restrain the shroud and the enclosed containers. Preferably the polyethylene is approximately 15–25 mils thick. Other materials exhibiting the appropriate elasticity but increased strength, such as, for example linear low density polyolefin resins may be utilized in reduced thickness. The carriers disclosed herein are disclosed in copending application Ser. No. 383,058, filed May 28, 1982 in the name of Frederick C. Allen which application is commonly assigned herewith.

The foregoing disclosure embodies the preferred embodiment of the practice in the best mode of the invention devised by the inventor. It is apparent, however, that packages incorporating modifications and variations will be obvious to one skilled in the art of package fabrication. Inasmuch as the foregoing disclosure is intended to enable one skilled in the art to practice the instant invention, it should not be construed to be limited thereby but be construed to include such aforementioned obvious variations. While a two-pack and a six-pack have been specifically illustrated, the present invention also specifically comprehends container arrays of four containers in a 2 by 2 array; eight containers in a 2 by 4 array; nine containers in a 3 by 3 array and twelve containers in a 3 by 4 array.

What I claim is:

1. A plural container package for securing together a plurality of identical containers, each said container having an open neck finish, an outstanding bead portion disposed below said finish portion, an angled shoulder portion disposed below said bead portions and an elongate, hollow, enlarged diameter closed bottom, main body portion in communication with said finish opening, said package comprising:

a plurality of said containers in a regular geometric array, a cover shroud overlying each said container of said array including a container shoulder engaging portion having a plurality of container receiving apertures in registry with said array of containers, with said container bead portions of said containers protruding through said container shoulder engaging portion and at least one panel portion integral with said container engaging portion and depending therefrom said panel portion terminating below said container shoulder portion, a carrier of elastic, thermoplastic material initially formed in a single sheet and comprising a first inner portion engaging each of the containers and disposed above the cover shroud and under said container bead portions of said containers and a second outer band portion surrounding said first portion and initially connected thereto along weakened lines, said cover shroud being formed from paperboard as a die cut blank and being initially positioned above the containers in proper registry therewith such that the cover shroud is lowered onto the container array and forced downwardly by installation of the carrier and such that as the second band portion of the carrier is severed from the first portion along the weakened lines, the band portion forces said panel portions along the main body portions of the containers and is stretched about the panel portions.

2. The package defined in claim 1 wherein said first portion of said carrier has a central, generally rectangular web portion connecting a pair of closed, curvilinear container engaging loop portions.

3. The package defined in claim 1 wherein said first portion of said carrier has a pair of curvilinear end portions adapted to engage said containers, said end portions being joined by a pair of side portions.

4. The package defined in claim 3 wherein an elastic thermoplastic web portion joins said side portion at their mid points.

5. The package defined in claim 2 wherein said first portion of said carrier has a plurality of container receiving apertures disposed in pairs in spaced apart relationship for receiving plural pairs of said containers.

6. The package defined in claim 5 wherein said shoulder engaging portion of said shroud includes a pair of centrally located hand grip apertures, said first portion of said carrier having enlarged openings aligned with said apertures such that the load of the package is applied to the shroud.

7. The package defined in claim 2 wherein said cover shroud includes a pair of integral opposed panel portions depending from said container shoulder engaging portion, said panel portions abut at their adjacent edges when secured under said band portion of said carrier.

8. The package defined in claim 2 wherein said cover shroud includes two pairs of integral opposed panel portions depending from said container shoulder engaging portion, said panel portions abutting to totally encase the upper portion of said container array when secured under said band portion of said carrier.

9. The package defined in claim 2 wherein said cover shroud includes a pair of integral opposed panel portions depending from said container shoulder engaging portion, each said integral opposed panel portion including a pair of opposed outstanding flap portions.

* * * * *

UNITED STATES PATENT AND TRADEMARK OFFICE

CERTIFICATE OF CORRECTION

PATENT NO. : 4,460,084

DATED : July 17, 1984

INVENTOR(S) : John L. Miller

It is certified that error appears in the above-identified patent and that said Letters Patent is hereby corrected as shown below:

Column 3, line 39, "cotainers" should read -- containers --.

Column 8, line 3, "bipartate" should read -- bipartite --.

Signed and Sealed this

*Eighteenth* Day of *December 1984*

[SEAL]

*Attest:*

GERALD J. MOSSINGHOFF

*Attesting Officer*

*Commissioner of Patents and Trademarks*